US008096850B1

(12) United States Patent
Heilig

(10) Patent No.: US 8,096,850 B1
(45) Date of Patent: Jan. 17, 2012

(54) HAND-HELD NOISEMAKER

(76) Inventor: Eberhard Heilig, Lacey, WA (US)

( * ) Notice: Subject to any disclaimer, the term of this patent is extended or adjusted under 35 U.S.C. 154(b) by 141 days.

(21) Appl. No.: 12/800,119

(22) Filed: May 10, 2010

(51) Int. Cl.
*A63H 5/00* (2006.01)
*A63H 33/00* (2006.01)

(52) U.S. Cl. ..... 446/397; 446/26; 446/421; 84/402

(58) Field of Classification Search ..... 446/26, 446/213, 397, 405, 406, 415, 418–421; 473/612; 84/102
See application file for complete search history.

(56) References Cited

U.S. PATENT DOCUMENTS

| | | | | |
|---|---|---|---|---|
| D351,627 | S | 10/1994 | Beckwith | |
| 5,659,143 | A * | 8/1997 | Isackson | 84/402 |
| 6,146,236 | A * | 11/2000 | Kay | 446/419 |
| 6,346,664 | B1 * | 2/2002 | Shuen | 84/402 |
| 7,001,238 | B1 | 2/2006 | Gonzalez | |
| D565,125 | S | 3/2008 | Collier | |
| D577,390 | S | 9/2008 | Collier | |
| 7,470,845 | B2 * | 12/2008 | Fermie et al. | 84/402 |
| 7,530,876 | B1 * | 5/2009 | Wimberly | 446/327 |
| 8,052,552 | B2 * | 11/2011 | Silverglate | 473/571 |
| 2003/0224689 | A1 | 12/2003 | Jenkins | |
| 2009/0077712 | A1 | 3/2009 | Polucha et al. | |
| 2009/0100572 | A1 | 4/2009 | Jones | |

* cited by examiner

*Primary Examiner* — Kien Nguyen
(74) *Attorney, Agent, or Firm* — Brian J. Coyne

(57) ABSTRACT

A hand-held noisemaker for use at sporting and other events. A dome-shaped, metal ringer is secured to a shallow, cup-shaped base by a lock knob having a parallel pair of barbed ends inserted into a keyway cutout of an upstanding boss within the base. A depending, cylindrical wall portion of the ringer is received within an annular recess of the base, but touches no part of the base. Whenever the noisemaker is shaken, and whenever two noisemakers are clapped together, a spherical ball within a closed, annular space defined by the ringer and base strikes the ringer, causing the ringer to emit a ringing sound.

5 Claims, 5 Drawing Sheets

HAND-HELD NOISEMAKER

CROSS REFERENCE TO RELATED APPLICATIONS

None.

STATEMENT REGARDING FEDERALLY APPROVED RESEARCH OR DEVELOPMENT

None.

BACKGROUND OF THE INVENTION

1. Field of the Invention

This invention relates generally to hand-actuated noisemaking devices, and, more particularly, to noisemaking devices that, when attached to the hands and shaken or clapped together, cause a metal ringer portion of each device to emit a ringing sound.

2. General Background

Sports fans, as well as participants at political rallies, weddings, New Year's Eve parties and other kinds of events, enjoy expressing their excitement and enthusiasm by clapping, shouting, stomping, horn blowing and other means of generating noise. My invention, which is intended for making noise at any of those kinds of occasions, provides a device that may be held in the palm of the hand—preferably one device in each hand—and shaken or clapped together to generate a metallic, ringing sound. The device creates noise in two ways. First, the device includes a ball that is captured between a base and metallic ringer such that shaking the device makes the ball repetitively strike the ringer, causing the ringer to emit a ringing sound. Second, when the devices are clapped together so that the ringer of one device strikes the ringer of another device, the ringers likewise emit metallic rings.

Prior to my invention, a variety of devices were known for creating noise at sporting and other kinds of events. U.S. Pat. No. 7,001,238 to Gonzalez disclosed a clapping apparatus comprising a knob-like handle fastened to a clapping plate; a pair of the devices could be clapped together to generate noise by impact of the plates against each other.

U.S. Pat. D577,390 S to Collier disclosed a hand-held noisemaker comprising a first, hemispherical half for the palm of the left hand and a second, hemispherical half for the palm of the right hand, which halves, when held together resemble the appearance of a basketball, and when struck against each other emit noise. Similarly, U.S. Pat. D565,125 S to Collier disclosed a hand-held noisemaker comprising two halves that together mimic the appearance of a football. Attachment to the hands of Collier's basketball and football noisemakers was by insertion of the index, middle and fourth fingers underneath straps attached to outer surfaces of each of the noisemaker halves.

U.S. Patent Application Publication US 2009/0100572 A1 of Jones disclosed a pair of gloves for achieving a louder clapping sound. Noisemaking members, preferably made of a firm plastic or other rigid polymer, were affixed to the palm and fingers of each glove.

U.S. Patent Application No. US 2009/0077712 A1 of Polucha et al. disclosed a hand-held, noisemaking device comprising a pair of gloves, the palm region of each glove being provided with a dome-shaped, hollow member formed of a rigid sound transmitting material. The hollow member extended upwardly from the surface of the palm portion of the glove so that, when the hollow members were clapped together, noise was generated.

U.S. Patent Application No. US 2003/0224689 A1 of Jenkins disclosed a food or drink container integrated with a noisemaking device. An enclosure containing at least one pellet was provided that, after the food or beverage was consumed, made noise when shaken as a fan cheered for a sports team.

SUMMARY OF THE INVENTION

My invention provides a noisemaker that may be held in the palm of the hand—preferably one noisemaker in each hand—and shaken or clapped together to generate a metallic, ringing sound. Each noisemaker comprises a base that is centered on an axis A-A, a dome-shaped, metal ringer, a locking knob for holding the metal ringer in axially-aligned, mating engagement with the base, a spherical ball captured between the base and ringer and free to move about therein and strike the ringer whenever the noisemaker is shaken or clapped against another device, as indicated by arrow 50 in FIG. 3, and means for attaching the noisemaker to at least one finger of one hand.

The base includes a disk-shaped bottom wall that is centered on and aligned normal to axis A-A, which base has a lower surface and an upper surface. The base further includes a cylindrical wall that is centered on and aligned along axis A-A. The cylindrical wall is attached to, and extends away from, the bottom wall of the base in an upward direction up to a circular, top margin. The base also includes an annular flange that surrounds, and extends radially outward from, the cylindrical wall near to, but below, the top margin of the cylindrical wall. A cylindrical rim extends axially upward and away from the flange. The flange, rim and cylindrical wall are dimensioned such that, in combination, they define an annular recess above the flange and between the rim and an upper portion of the cylindrical wall. The base further includes an upstanding boss that is centrally disposed within the base and extends upward from the bottom wall of the base to a top surface. In a preferred embodiment, the boss is cylindrical and centered on, and aligned along, axis A-A. The top surface of the boss has a centrally-disposed, keyway cutout.

The dome-shaped, metal ringer is centered on axis A-A. The ringer includes a top wall disposed normal to axis A-A. The top wall has a circular periphery and a recessed, central area that is dimensioned for mating engagement with the top surface of the boss. The central area has a central opening that is centered on axis A-A. The ringer further includes a cylindrical, ringer wall that extends from the circular periphery of the top wall of the ringer down into the annular recess of the base. The ringer wall is dimensioned to be received within the annular recess of the base without touching any portion of the base—otherwise, the sound emitted by the ringer would be muffled by contact with the base.

The locking knob has an enlarged, head end and an opposite, axially-directed shank end that is inserted through the central opening of the ringer and into the keyway cutout of the boss, which thereby attaches the ringer to the base. The shank end of the locking knob preferably includes a parallel pair of members that each terminate in a barb end, and the keyway cutout in the boss is shaped and dimensioned to receive and retain the barb ends.

A spherical ball is captured within the closed, annular space between the boss, the cylindrical wall of the base, and the ringer. The ball, preferably a glass ball, is dimensioned and disposed to make repetitive impacts with the ringer whenever the noisemaker is being shaken or whenever two of the noisemakers are being clapped together.

Means are provided for attaching the noisemaker to at least one finger of one hand, preferably to the middle finger, so that the base of the noisemaker rests against the palm of the hand. In a preferred embodiment, said means comprises a symmetrically apposed pair of arcuate members attached to a lower surface of the base. The arcuate member's arch toward one another and cooperate to form a ring that is dimensioned to receive at least one finger of one hand.

BRIEF DESCRIPTION OF THE DRAWINGS

Like numerals designate like component parts throughout the several views.

DESCRIPTION OF THE PREFERRED EMBODIMENT

Figure 2:
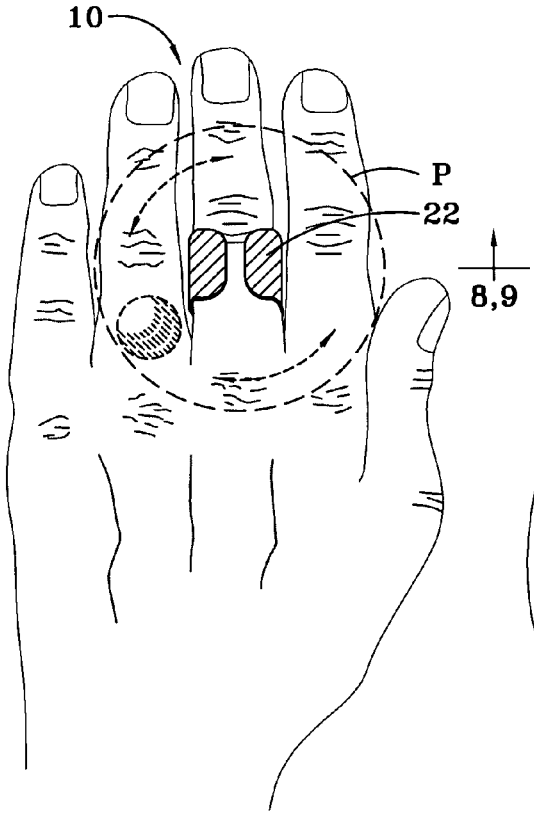
FIG. 2 is an elevational view of the back of a left hand, depicting a second noisemaker attached to the left hand by a middle finger inserted through a ring portion of the base of the noisemaker.
Figure 1:
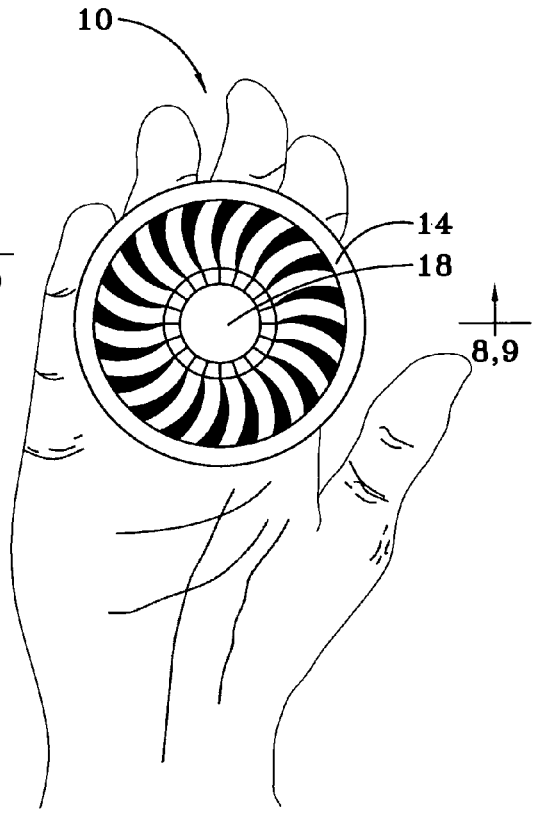
FIG. 1 is an elevational view of a first noisemaker attached to the palm side of a human hand.
Figure 3:
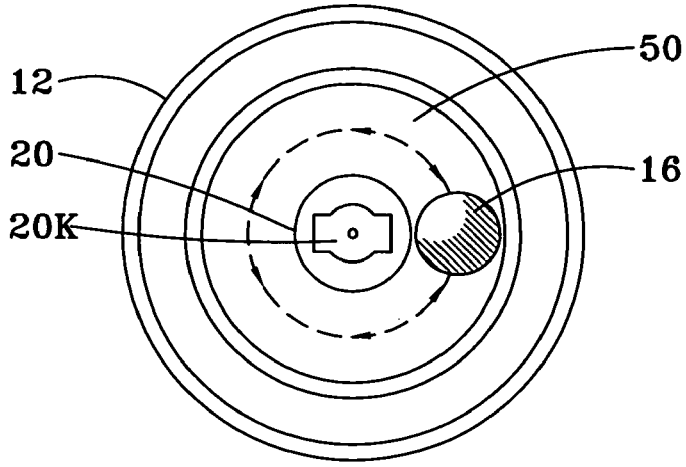
FIG. 3 is a schematic, top plan view of the base portion and spherical ball thereof, with ringer portion removed for clarity.
Figure 4:
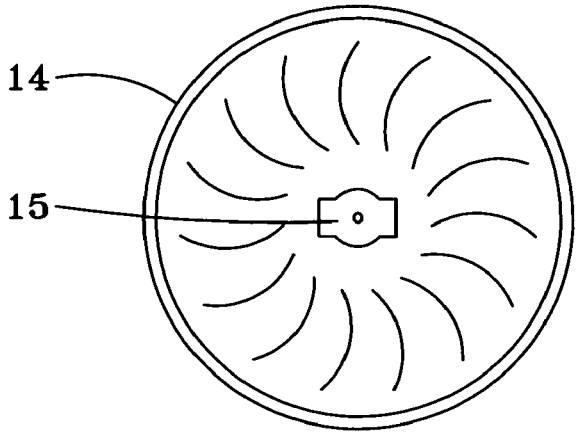
FIG. 4 is a top plan view of the ringer portion thereof.
Figure 5:
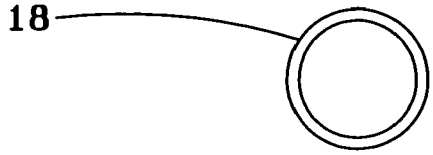
FIG. 5 is a top plan view of the locking knob portion thereof.
Figure 6:
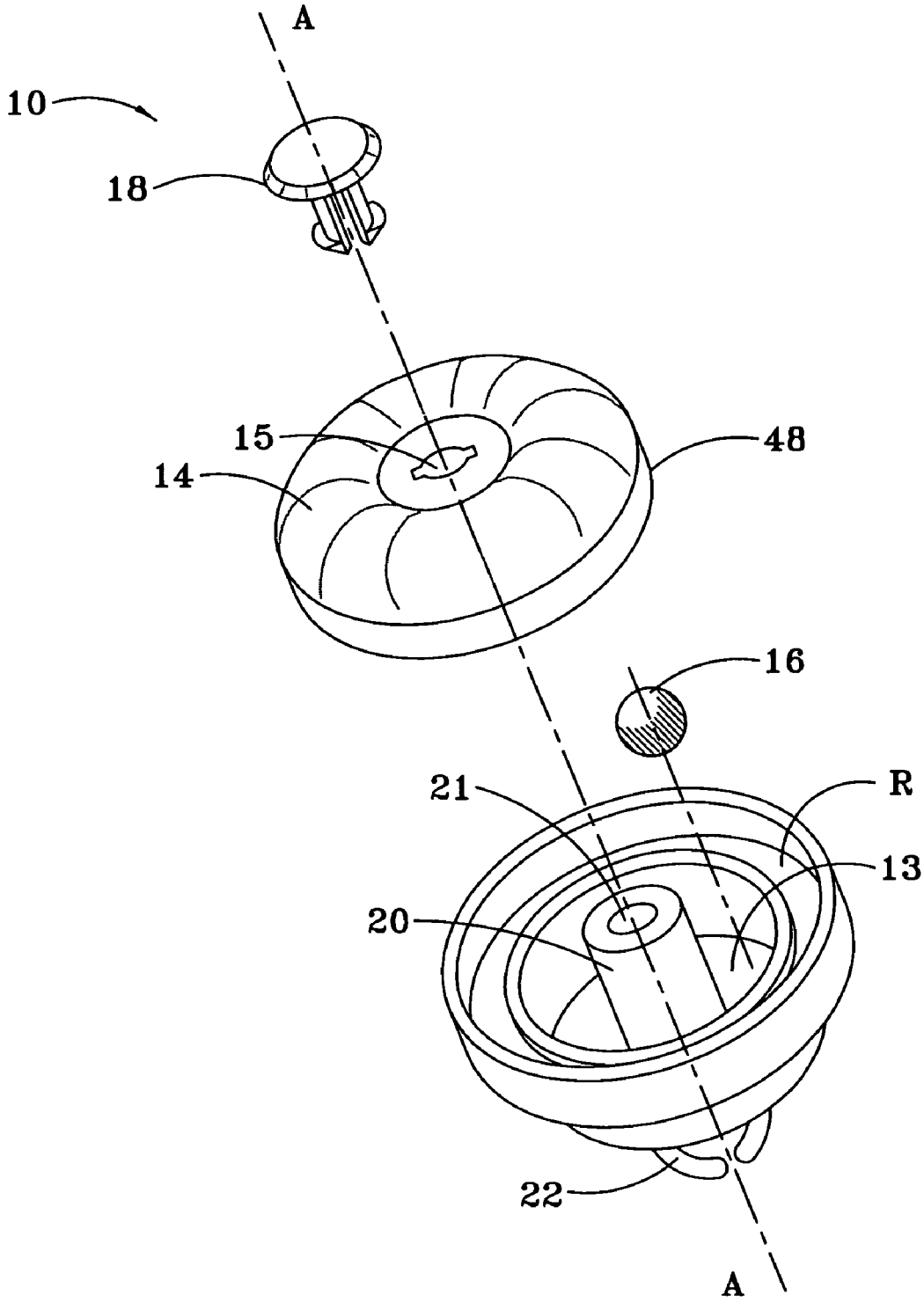
FIG. 6 is an exploded, perspective view of a noisemaker according to the invention.
Figure 7:
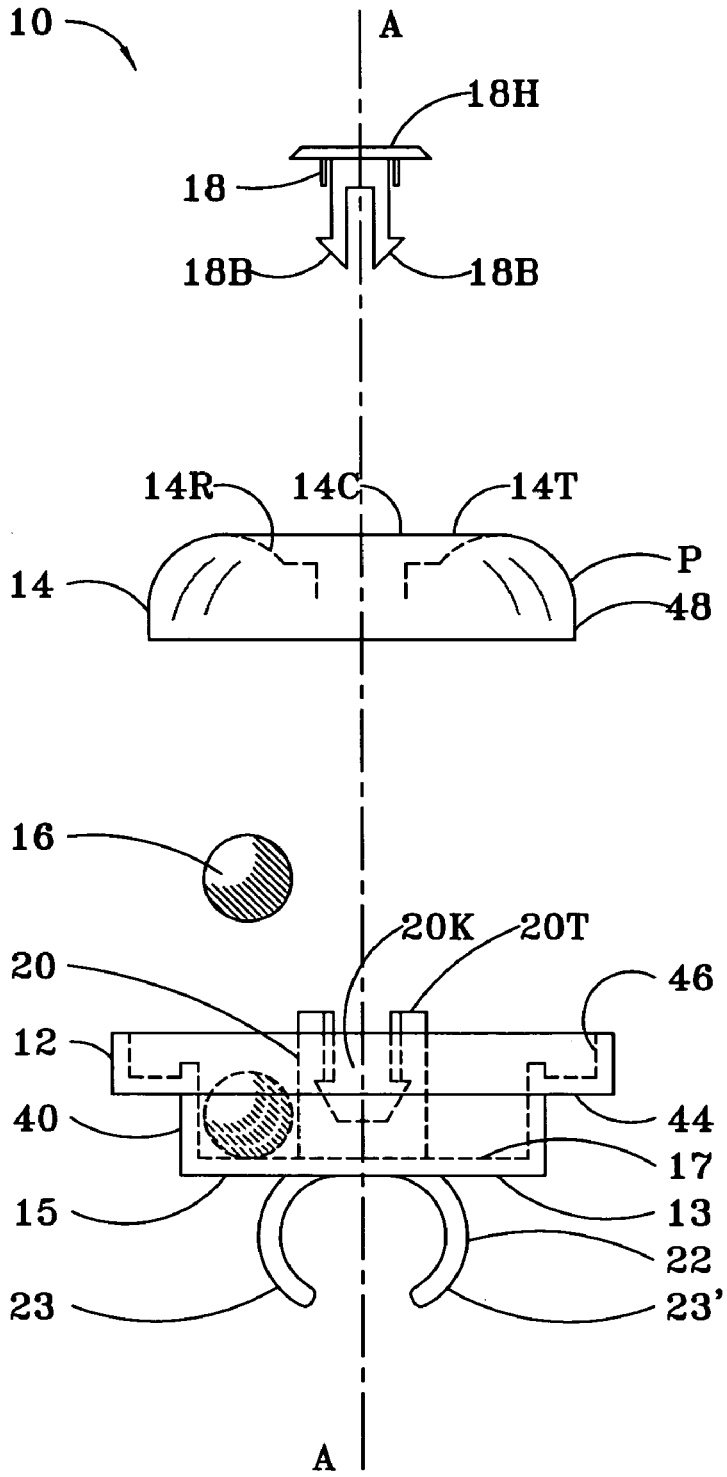
FIG. 7 is an exploded, side elevational view thereof.

FIG. 1 depicts a preferred embodiment of my noisemaker, denoted generally by the numeral 10, attached to the palm side of a right hand. FIG. 2 depicts a second such noisemaker 10 attached to a left hand, wherein it may be seen that the noisemakers are secured to the palm sides of the hands by insertion of a middle finger of each hand through a ring portion 22 of each noisemaker. Referring to FIGS. 3-7, it may be seen each noisemaker 10 includes a shallow, cup-shaped base 12 that is sized and shaped to comfortably fit within the palm of a hand, a dome-shaped, metallic ringer 14, a spherical ball 16, and a locking knob 18 for attaching the ringer to the base and for capturing the ball within the closed space defined by the base and the ringer. For purposes of description, it will be supposed that the noisemaker 10 is oriented as depicted in FIG. 7 such that the ringer 14 vertically overlies the base 12 and the lock knob 18 vertically overlies the ringer.

Figure 8:
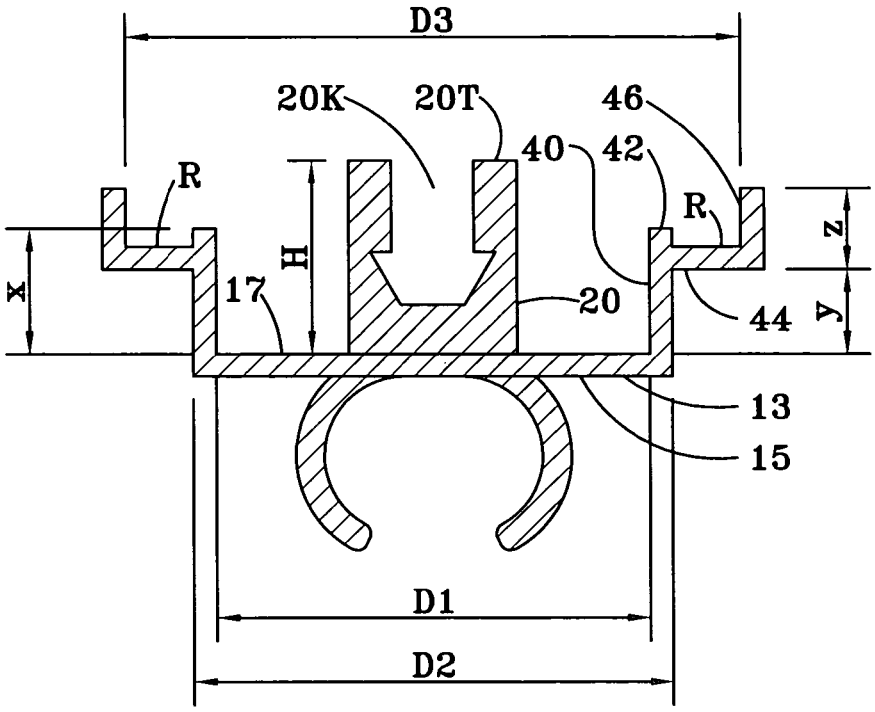
FIG. 8 is an enlarged, vertical, cross-sectional view taken along line 8-8 of FIG. 1 through a base portion thereof.

The base 12 includes a disk-shaped bottom wall 13 that is centered on, and disposed normal to, an axis A-A. The bottom wall 13 has a lower surface 15 and an upper surface 17. The base 12 further includes a cylindrical wall 40 that is centered on, and aligned along, axis A-A. Referring to FIG. 8, the cylindrical wall 40 extends upward from the bottom wall 13 up to a top margin 42 a distance x measured from the upper surface 17 of the bottom wall. The cylindrical wall 40 has inner diameter $D_1$ and outer diameter $D_2$. At a vertical distance y above the upper surface 17 of the bottom wall 13, an annular flange 44 is aligned on, and normal to axis A-A, and extends radially outward from the cylindrical wall 40. A cylindrical rim 46 extends upward and away from the flange a vertical distance z. The cylindrical rim 46 has internal diameter $D_3$. The flange 44 is located a little below the top margin 40 of the cylindrical wall 40—that is, x is greater than y. Moreover, the rim 46 preferably extends higher than the top margin 42 of the cylindrical wall 40—that is, z is greater than or equal to x minus y. The internal diameter $D_3$ of the rim 46 is greater than the outer diameter $D_2$ of the cylindrical wall 40 and, of course, the outer diameter $D_2$ of the cylindrical wall 40 is greater than its inner diameter $D_1$. Moreover, the diameter of the base wall 13 preferably is also $D_2$. Thus, in combination, the rim 46, cylindrical wall 40, and annular flange 13 define an annular recess R in the base 12.

The base 12 further includes an upstanding boss 20 that is centered on axis A-A, and is attached to, and extends upward from, the bottom plate 13 a vertical distance that exceeds y plus z; that is, the boss 20 preferably extends higher than the rim 46. The boss 20 is preferably cylindrical with diameter less than $D_1$ minus twice the diameter of the spherical ball 18 so that there will be sufficient room for the ball to move around between the boss and the ringer 14. The boss 20 has a top surface 20T in which a keyway 20K is cutout. The keyway cutout 20K is shaped and dimensioned to receive and retain the parallel pair of barbed, shank ends 18B of the knob lock 18; see FIG. 8.

Figure 9:
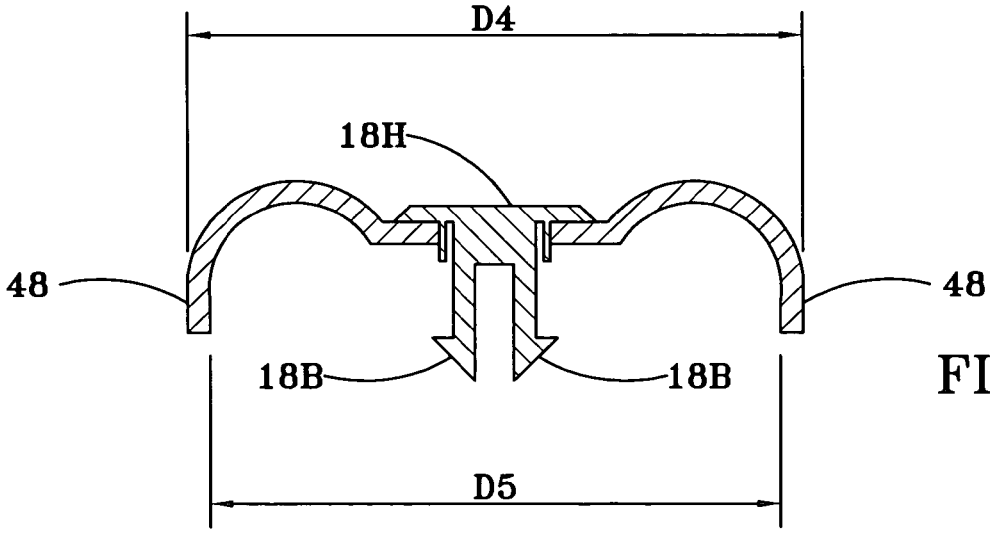
FIG. 9 is an enlarged vertical, cross-sectional view taken along line 9-9 of FIG. 1 through the ringer portion thereof.

The metal ringer 14 is generally dome-shaped and centered on axis A-A. The ringer includes a top wall 14T having a circular periphery and a central area 14C that is dimensioned for mating engagement with the top surface 20T of the boss 20. A parallel pair of shank ends 18B of the knob lock 18 are inserted through a central opening 15 within the central area 14C of the ringer top wall 14T and into the keyway cutout 20K. An enlarged head-end 18H of the knob lock 18 overlies the central area 14C and thereby presses against the ringer top wall 14T. The central area 14C is preferably recessed at 14R, as is the knob lock 18, so that when two noisemakers 10 are clapped together, their top walls 14T will impact, and not their knob locks. The ringer 14 further includes a cylindrical, ringer wall 48 that extends from the ringer periphery P vertically down into the annular recess R of the base 12. The ringer wall 48 and boss 20 are dimensioned such that the ringer wall touches no part of the base 12, and that permits the ringer 14 to freely vibrate whenever the noisemaker 10 is shaken or clapped. To ensure that result, the outer diameter $D_4$ of the ringer wall 48 is less than the inner diameter $D_3$ of the rim 46 and the inner diameter $D_5$ of the ringer wall is greater than the outer diameter $D_2$ of the cylindrical wall; compare FIGS. 8 and 9. To the same end, the height H of the boss 20, measured from the upper surface 17 of the bottom wall 13 to the top surface 20T of the boss, is large enough to prevent the ringer wall 48 from touching the flange.

The base 12 is preferably fabricated of plastic as one integrated unit, including the bottom plate 13, the boss 20, the cylindrical wall 40, the flange 44, the rim 46 and the ring 22. The knob lock 18 can be fabricated from plastic and/or sheet metal. The ball is preferably a glass ball, but other suitably hard and durable materials could be substituted. The ringer 14 is preferably fabricated from sheet metal, such as aluminum.

The preferred method of use is as follows. A first noisemaker 10 is attached to the right hand and a second noisemaker 10 is attached to the left hand, by inserting a respective middle finger of each hand through a ring 22 attached to a lower surface of the bottom wall 13 of a noisemaker and then holding the bases 12 of the noisemakers in the palms of the hands. The ring 22 includes a symmetrically apposed pair of arcuate members 23, 23' attached to a lower surface 15 of the base 12, which members arch toward one another and cooperate to form a ring. To make noise, the noisemakers may be shaken with the left and/or right hand, and/or the noisemakers may be clapped together. These actions cause noise to be generated in two ways: first, by causing the ball to ricochet back and forth between the boss 20 and the ringer 14; and second, by direct impacts to the top walls 14T of the ringers.

The barbed ends 18B of the knob lock 18 are so firmly retained within the keyway cutout 20K, that not even vigorous shaking and clapping will cause the noisemakers 10 to come apart.

Although the above description and accompanying drawings relate to a specific preferred embodiment of the present invention as presently contemplated by the inventor, it will be understood that various changes, modifications and adaptations may be made without departing from the spirit of the invention. For instance, a strap having spaced-apart, opposite ends attached to the lower surface 15 of the bottom wall 13 of the base 12 and of suitable length to receive one or more fingers could be substituted for the ring 22. It is intended that the invention not be limited to the particular terms used in the following claims and/or to the particular embodiments disclosed as the best mode contemplated for carrying out this invention, but that the invention will include any and all embodiments and equivalents falling within the scope of the appended claims.

I claim:

1. A hand-held noisemaker, comprising:

a base, which base includes a disk-shaped bottom wall that is centered on, and disposed normal to, an axis A-A, said bottom wall having a lower surface and an upper surface;

a cylindrical wall centered on, and aligned along, said axis, said wall being attached to, and extending away from, said bottom wall in a first, upward direction up to a circular, top margin of said wall a distance x from the upper surface of said bottom wall, and said cylindrical wall having inner diameter $D_1$ and outer diameter $D_2$;

an annular flange aligned on, and normal to, said axis, said flange having a lower surface and an upper surface and being attached to said cylindrical wall at a distance y from said upper surface of said bottom wall and extending radially outward therefrom;

a cylindrical rim that extends axially away from said flange in the first, upward direction a distance z, said rim having an internal diameter $D_3$;

wherein x is greater than y, z is greater than or equal to x minus y, $D_3$ is greater than $D_2$, $D_2$ is greater than $D_1$, whereby said rim, cylindrical wall and flange combine to define an annular recess in the base;

an upstanding boss centrally disposed within the base, said boss being attached to, and extending axially away from, the bottom wall in said first, upward direction, a top surface of said boss having a keyway cutout;

a metal ringer (14), said ringer centered on said axis, said ringer including:

a top wall having a circular periphery, said top wall having a central area that is dimensioned for mating engagement with a top surface of the boss, and a central opening within said central area;

a cylindrical, ringer wall that extends from said periphery in a second, downward direction from said top wall toward the bottom wall of the base;

wherein said ringer wall and said boss are dimensioned such that the ringer wall is received within the annular recess of the base without touching any portion of the base;

a locking knob, said knob having an enlarged, head end and an opposite, pair of axially-directed, barbed shank ends that are inserted through the central opening of the ringer and into the keyway cutout of the boss, whereby the ringer is secured to the base and the base and ringer together define a substantially closed space;

a spherical ball captured within said closed space between the base and the ringer, said ball being dimensioned and disposed to make repetitive impacts with the ringer whenever the noisemaker is being shaken; and means for attaching the noisemaker to a human hand with the base of the noisemaker engaging the palm of the hand.

2. The noisemaker of claim 1, wherein said central area of the ringer and said lock knob are recessed in the second direction.

3. The noisemaker of claim 2, wherein the ball is a glass ball.

4. The noisemaker of claim 3, wherein the boss is cylindrical, whereby the base, ringer and boss together define a closed, annular space within which the ball is free to move.

5. The noisemaker of claim 4, wherein said means for attaching the noisemaker to a human hand includes a symmetrically apposed pair of arcuate members attached to a lower surface of the base, which members arch toward one another and cooperate to form a ring that is dimensioned to receive at least one finger of one hand.

* * * * *